United States Patent [19]

Meeker et al.

[11] Patent Number: 4,492,308

[45] Date of Patent: Jan. 8, 1985

[54] QUICK OPENING ENVELOPE

[75] Inventors: David M. Meeker, Saratoga; Harold R. Lillibridge, Burlingame, both of Calif.

[73] Assignee: Champion International Corporation, Stamford, Conn.

[21] Appl. No.: 571,642

[22] Filed: Jan. 17, 1984

Related U.S. Application Data

[63] Continuation of Ser. No. 448,794, Dec. 10, 1982, abandoned, which is a continuation-in-part of Ser. No. 353,176, Jul. 1, 1982, abandoned.

[51] Int. Cl.[3] ..... B65D 27/34

[52] U.S. Cl. ..... 206/610; 206/632

[58] Field of Search ..... 206/610, 628, 632, 626

[56] References Cited

U.S. PATENT DOCUMENTS

| | | | |
|---|---|---|---|
| 570,380 | 10/1896 | Chalmers | 206/628 |
| 1,336,646 | 4/1920 | Mendenhall | 206/610 |
| 3,460,743 | 8/1969 | Burnett | 229/70 |
| 3,489,332 | 1/1970 | Knittel | 229/80 |
| 3,522,907 | 8/1970 | Utterback, Jr. | 229/68 |
| 3,652,008 | 3/1972 | Grotefend | 206/610 |
| 3,773,251 | 11/1973 | Hadick | 229/92.8 |
| 3,853,262 | 12/1974 | Tucker et al. | 206/632 |
| 4,093,074 | 6/1978 | Bielawski | 206/629 |

FOREIGN PATENT DOCUMENTS

| | | | |
|---|---|---|---|
| 112505 | 12/1968 | Fed. Rep. of Germany | 206/626 |
| 1471277 | 1/1967 | France | 206/626 |
| 314216 | 1/1934 | Italy | 229/82 |

*Primary Examiner*—Stephen P. Garbe

*Attorney, Agent, or Firm*—Evelyn M. Sommer; John H. Mulholland; William W. Jones

[57] ABSTRACT

A quick opening envelope which gives full access to its interior upon opening is disclosed. The envelope is formed from a blank constructed from a single sheet of flexible material having a plurality of fold lines defining a front panel, a back panel, two side flaps and a closure flap. The back panel is attached to marginal areas of the side flap by means of a releasable adhesive material and to a central tab portion of the closure flap by conventional adhesive material. The closure flap tab is defined by a V-shaped formation of die cut perforations, each of which includes a curved portion and a straight portion. The V-shaped formation of perforations enables neat and easy opening of the envelope by lifting to separate the tab from the closure panel and the back panel from the side panels.

4 Claims, 4 Drawing Figures

QUICK OPENING ENVELOPE

CROSS REFERENCE TO RELATED APPLICATION

This application is a continuation of application Ser. No. 448,794, filed Dec. 10, 1982, now abandoned, which is a continuation-in-part of copending application Ser. No. 353,176, filed Mar. 1, 1982 now abandoned.

BACKGROUND OF THE INVENTION

This invention relates to envelopes. More particularly, it relates to quick opening envelopes which provide for easy and full access to their interior for the safe withdrawal of their contents.

It is well known that the usual method of opening an envelope after the latter has been sealed entails the insertion of a letter opener or like instrument at one corner of the envelope to shear at least one folded edge portion thereof. Although this method proves satisfactory in most instances, it has a number of substantial drawbacks. The main drawback is that in many instances the individual opening the envelope, in addition to shearing the folded edge of the envelope, will inadvertently shear a folded edge of the document contained therein.

Moreover, once an envelope has been opened in the above manner, it is impossible to reclose it so as to assure that its contents, if returned to the envelope, will not fall out. In this respect, envelopes are often opened by simply tearing the glued flap portion away from the body of the envelope. Although this solves the problem of reclosure, it often results in the tearing of the envelope, thereby leaving a ragged unsightly condition.

Other procedures used for opening envelopes include tearing the side edge portion, however, this has also proved unsatisfactory since, if the enclosed letter fills the envelope flush to the end, which in most instances is the case, the contents of the envelope may be mutilated.

In order to overcome the above-identified drawbacks, a number of quick opening envelopes have been developed. Although these envelopes have overcome many of the problems associated with prior art techniques, they are in many cases unsightly, require special handling during manufacturing, are expensive to make and therefore expensive to use, and do not provide full access to the interior of the envelope when opened.

Accordingly, it is an object of the subject invention to provide a quick opening envelope that can be opened easily and cleanly without separate tools and without the risk of damaging the contents of the envelope.

It is another object of the subject invention to provide a quick opening envelope which when opened, will give full access to the contents of the envelope.

It is a further object of the subject invention to provide a quick opening envelope that can be neatly and partially reclosed.

It is still another object of the subject invention to provide a quick opening envelope wherein the opening mechanism does not interfere with the portion of the envelope on which the name and address of the addressee appears.

Finally, it is still another object of the subject invention to provide a quick opening envelope which can be economically produced with a minimum amount of material and which can be constructed from a single integrally formed blank.

SUMMARY OF THE INVENTION

In accordance with this invention, an improved quick-opening envelope has been provided. The subject quick opening envelope is constructed from a single sheet of foldable material comprising five panels or flaps. More specifically, a substantially rectangular front panel is provided for bearing the name and address of the addressee. Side flaps are hingedly attached to opposite side edges of the front panel and define the enclosed end portions of the subject envelope. A back panel is hingedly attached to the bottom edge of the front panel, and is folded over and releasably adhesively attached along side margins thereof to the side flaps. A closure flap is hingedly connected to the top edge of the front panel and can be adhesively secured to the back panel thereby closing the subject envelope. The closure flap includes a plurality of elongated perforations arranged in a wide V formation, with the apex of the wide V nearest the hinged connection between the front panel and closure flap. The elongated perforation at the apex of the V defines a pull tab which can be readily grasped by a thumb and forefinger. A force exerted on the pull tab enables a separation of the closure flap along the elongated perforations and the separation of the back panel from the side flaps along its releasably adhesively attached side margins to easily and cleanly open the subject quick opening envelope.

This design provides an envelope that can be securely closed, but that can be quickly and easily opened. Additionally, the design enables the subject envelope to be partially and neatly reclosed.

Further objects and advantages of the invention will become apparent from reading the following detailed description taken in conjunction with the drawings.

DESCRIPTION OF THE PREFERRED EMBODIMENT

Figure 1:
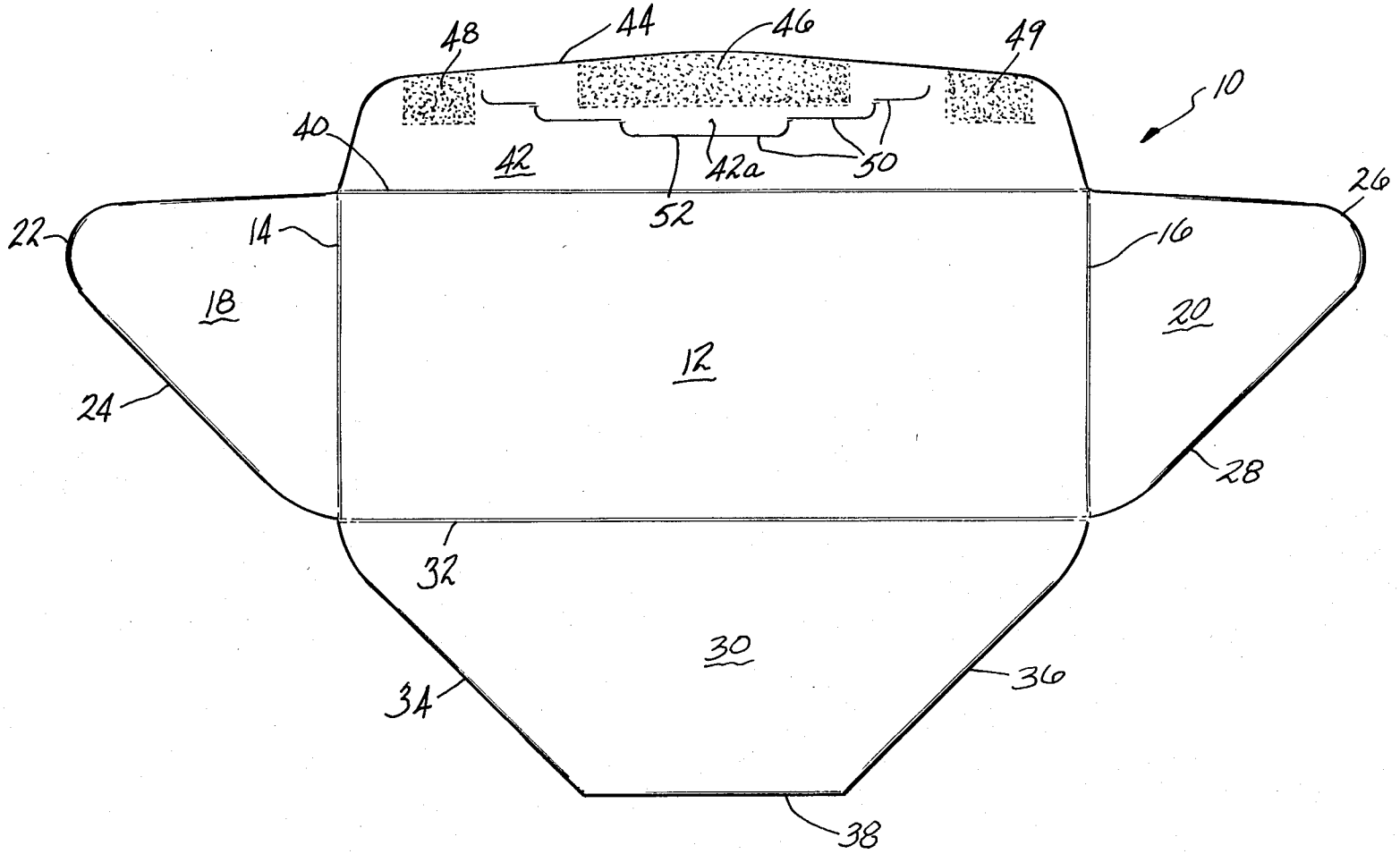
FIG. 1 is a plan view of the blank for forming the subject envelope.

Referring to FIG. 1, the quick opening envelope of the subject invention is indicated generally by the number 10. Envelope 10 includes a substantially rectangular front panel 12 that, typically, is approximately $8\frac{7}{8}$ inches long and $3\frac{7}{8}$ inches high. Hingedly connected to front panel 12 by means of fold lines 14 and 16 are side flaps 18 and 20. In the completed envelope, side flaps 18 and 20 lay flat against the inside surface of front panel 12. Corners 22 on side flap 18 and 26 on side flap 20 are rounded to facilitate the formation of the subject envelope, and to make insertion of items into the folded envelope easier. Side flap 18 has a lower edge 24 adjacent corner 22 and side flap 20 has a lower edge 28 adjacent corner 26.

Back panel 30 is hingedly connected to front panel 12 along fold line 32. Back panel 30 is substantially trapezoidal with edge 38 being substantially parallel to, but shorter than fold line 32. Edge 34 of back panel 30 is parallel to edge 24 of side flap 18. Similarly, edge 36 of back panel 30 is parallel to edge 28 of side flap 20. By this arrangement, the edges of back panel 30 and side flaps 18 and 20 will be parallel on the folded envelope. Marginal releasable adhesive strips 35 and 37 are adjacent edges 24 and 28 respectively of side flaps 18 and 20 and releasably attach back panel 30 to side flaps 18 and 20 on the completed envelope. The releasable adhesive strips 35 and 37 are of a material such as a mixture of 7 parts by volume of low adhesion polyvinyl acetate and 1 part by volume of commercial envelope window gum which is typically a polyvinyl acetate and ethylene vinyl acetate copolymer. These materials are commercially available from a number of suppliers such as National Starch & Chemical Corporation, 10 Sinderne Avenue, Bridgewater, N.J. Other releasable adhesives may also be used.

Closure flap 42 is hingedly connected to front panel 12 along fold line 40. Adhesive strip 46 is adjacent to and centrally located on outer edge 44 of closure flap 42. This configuration ensures that the central portion of the completed envelope closure flap 64 will be adhered only to back panel 30. Adhesive strips 48 and 49 are arranged on either side of strip 46 for adhesion to side flaps 18 and 19, respectively. Adhesive strips 46, 48 and 49 are of normal envelope glue that becomes bondable on contact with moisture. Pressure sensitive adhesives may also be used.

Elongated perforations 50 are arranged in flap 42 in essentially a V formation. The apex of the V formation is defined by an elongated die cut perforation 52 with curved ends which has its convex side spaced from and facing fold line 40. Each perfora-50 includes a curved portion 54 and a straight portion 56. Straight portions 56 are parallel to one another and to fold line 40. The V formation formed by perforation 50 stops short of the edge 44.

The subject envelope 10 is formed from the blank described herein by first folding end flaps 18 and 20 toward each other along fold lines 14 and 16 respectively such that end flaps 18 and 20 are in surface to surface contacting relationship with front panel 12. Subsequently, back panel 30 is folded into surface to surface contacting relationship with side panels 18 and 20 and front panel 12. Adhesive strips 35 and 37 on side panels 18 and 20 are releasably secured to back panel 30 thereby securing the blank into the form of an envelope. Closure flap 42 may be folded along fold line 40 into face to face contacting relationship with back panel 30, front panel 12 and side flaps 18 and 20. Closure flap 42, of course, would not be adhesively secured to back panel 30 and side flaps 18 and 20 during shipping and storage prior to use. However, after insertion of the item to be mailed into envelope 10, closure flap 42 is adhesively secured to back panel 30 by means of adhesive strip 66 and side flaps 18 and 20 by means of adhesive strips 48 and 49, respectively.

Figure 3:
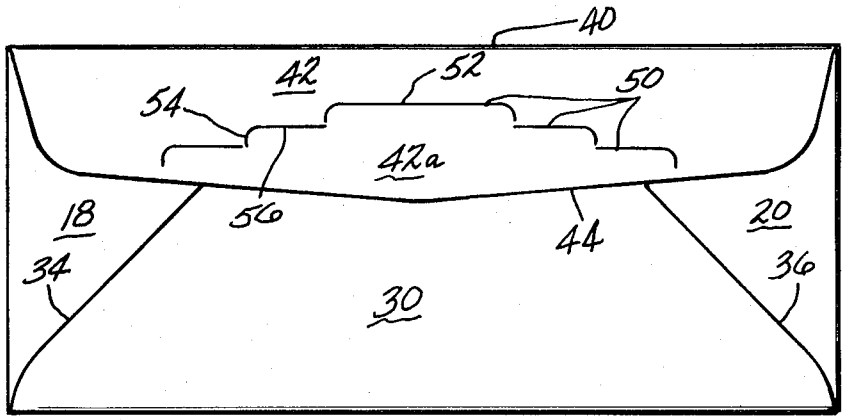
FIG. 3 is a plan view of the subject envelope viewed from the back with the closure flap in the closed position.

The quick opening features of the subject envelope would be initiated when the envelope 10 is in the closed position as shown in FIG. 3. To employ the quick opening feature, the user of the envelope grasps tab 42*a* formed by perforation 52 and the rest of the V formation with a thumb and forefinger. The relatively large size of perforation 52 and the proximity of the V formation of perforations 50 to outer edge 44 of flap 42 facilitates the grasping of tab 42*a*. To even further facilitate the initial grasping of tab 42*a*, the user merely bends envelope 10 slightly, causing the plane thereof to become discontinuous, and causing tab 42*a* to separate slightly from flap 42.

Figure 4:
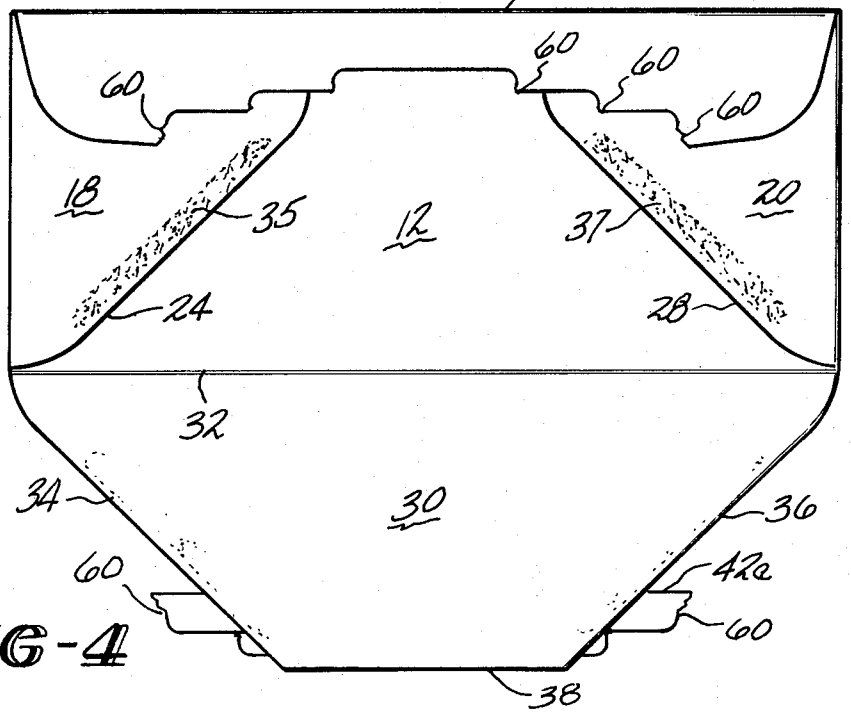
FIG. 4 is a plan view of the subject envelope viewed from the back with closure panel entirely separated along the elongated perforations and the back panel separated from the side flaps along its releasably adhesively attached side margins.
Figure 2:
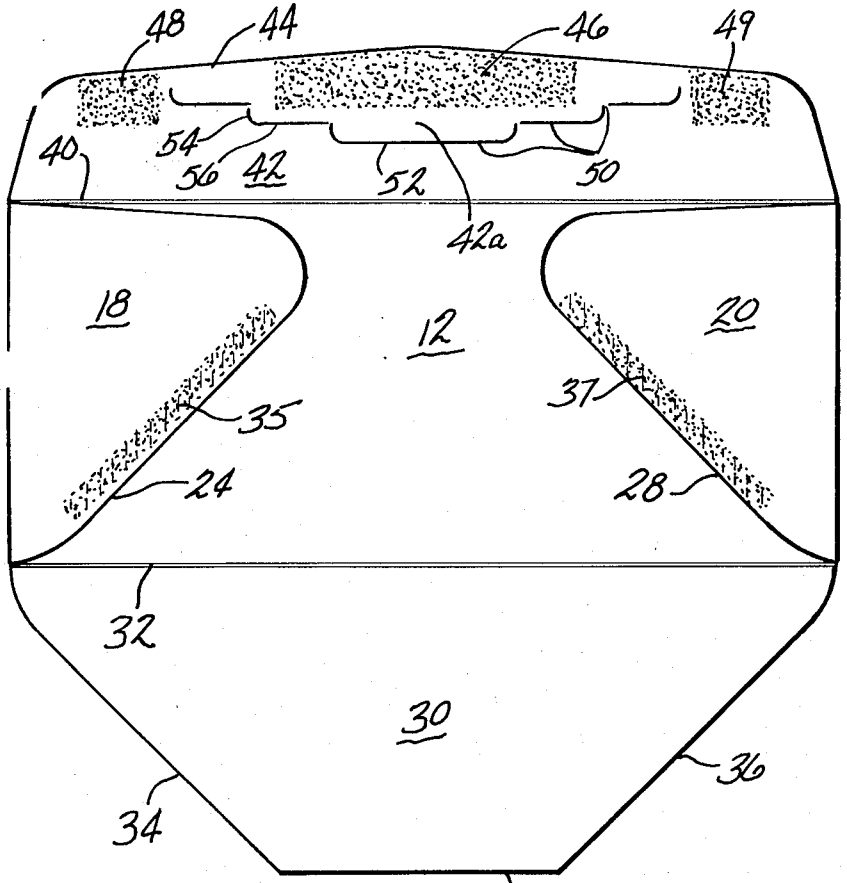
FIG. 2 is a plan view of the subject envelope viewed from the back with the side flaps folded into position.

After initially grasping tab 42*a*, the user of envelope 10 pulls tab 42*a* away from the plane defined by flap 42, and toward bottom edge 32 of envelope 10. This pulling force successivley tears flap 42 of envelope 10 between perforations 50 and flap edge 44. As shown in FIG. 4, the tear lines 60 formed by this pulling will be substantially parallel to the direction of the force exterted on tab 42*a*. Thus, the severance lines 60 between adjacent perforations 50 will be substantially perpendicular to top and bottom edges 32 and 40 of envelope 10. In most instances, pairs of severance lines 60 will be formed simultaneously on opposite legs of the V formation. The straight portions 56 of elongated perforations 50 function as temporary and varying force lines as tab 42*a* is being pulled from back panel 30. Straight portions 56 also ensure that a force exerted on tab 42*a* that is not precisely perpendicular to top and bottom edge 32 and 40 of envelope 10 will not unintentionally rip flap 42*a*. This tendency of the lifted portion of flap 42*a* not to tear, can be attributed to the differential twisting thereof that is enabled by straight portions 56 of perforations 50.

As seen above, closure flap 42*a* is adhered only to the back panel 30. Thus, as the last tear lines 60 are being formed by the lifting force on tab 42*a*, the tab 42*a* and the back panel 30 to which it adheres are pulled back and the adhesive areas 35 and 37 release to free the back panel 30. By this action, a neat, clean opening of envelope 10 is provided, along perforation 52 and the edges 24 and 28 of side panels 18 and 20.

After being opened, as shown in FIG. 4, envelope 10 may be partially reclosed merely by folding back panel 30 back toward its original position. The back panel 30 and flap 42*a* that has been lifted, may be slid under the stationary portions of the closure flap 42 and the edges 24 and 28. This minor frictional engagement generally will be sufficient to hold envelope 10 in a partially closed condition.

Accordingly, there is provided a quick opening envelope comprising a front panel, two side flaps foldably connected to opposite side edges of the front panel, a back panel foldably connected to the bottom edge of the front panel, and a closure flap foldably connected to the top edge of the front panel. The closure flap includes a plurality of die cut perforations arranged thereon in a wide V formation. The apex of the V defines a tab that is easily graspable. An upward force exerted on the tab will sever the closure flap between adjacent perforation thereby providing quick and easy access to the contents of the envelope. More specifically, the relationship between the perforations, the side flaps, the adhesive strip on the closure flap and the reclosable adhesive strips on the side flaps enables the back panel to be opened along with the severed closure flap.

The subject invention, and many of its intended advantages will be understood from the foregoing description, and it will be apparent that various changes may be made in the form of the subject quick opening envelope without departing from the spirit and scope of the invention as defined by the following claims.

What is claimed is:

1. A quick opening reclosable envelope constructed from a single sheet of flexible sheet material, said envelope comprising:

a substantially rectangular front panel having opposed inner and outer surfaces and a top edge, a bottom edge, and first and second opposed side edges;

first and second side flaps having opposed inner and outer surfaces and being hingedly connected respectively to said first and second opposed side edges of said front panel, the inner surfaces of said first and second side flaps being in abutting relationship with said inner surface of said front panel;

a planar back panel having opposed inner and outer surfaces, and a top edge, a bottom edge, and two opposed side edges, the bottom edge of said back panel being hingedly connected to the bottom edge of said front panel; and the inner surface of said back panel being attached with releaseable adhesive material to the outer marginal surfaces of said first and second side flaps;

a closure flap having opposed inner and outer surfaces, and a top edge hingedly connected to the top edge of said front panel, an adhesive portion being centrally disposed on said inner surface of said closure flap adjacent the free edge thereof opposite said top edge thereof, the distance from said top edge of said closure flap to said adhesive portion thereof being such that said closure flap may be adhesively secured to the outer surface of said back panel thereby securely closing said envelope;

a V-shaped formation of elongated perforations in said closure flap each perforation of which includes a curved portion and a straight portion, each of said straight portions extending substantially parallel to said bottom edge of said back panel, said straight portions of each of said perforations accomodating the bending and twisting of the portion of said closure flap lifted which occurs during an envelope opening operation;

the apex of said V being the closest part of said V to the top edge of said front panel and defining a pull tab for separating said closure flap along said perforations and along a pair of severance lines substantially perpendicular to the top edge downwardly to the free edge for separating said back panel from the outer marginal surfaces of said first and second side flaps for opening said envelope.

2. A quick opening envelope as in claim 1, wherein the straight portions of said perforations are spaced a substantially equal distance from each other and said V-shaped formation of perforations has a pair of formation ends located at a distance from the apex thereof and separated from the free edge of the closure flap by a distance that is approximately the distance between said straight portions of said perforations.

3. A quick opening envelope as in claim 1, wherein said closure flap includes adhesive material along its free edge outside of said V-shaped arrangement of perforations for adhesion to said side flaps.

4. A blank having opposed inner and outer surfaces for forming a quick opening reclosable envelope, said blank comprising:

a substantially rectangular front panel having a top edge, a bottom edge and first and second opposed side edges;

first and second substantially identical side flaps with angled lower edges hingedly connected respectively to said first and second opposed side edges of said front panel and having a releaseable adhesive material adjacent said lower edges on back marginal areas of said flaps;

a back panel having a bottom edge hingedly connected to the bottom edge of said front panel, and side edges substantially parallel to the side flap lower edges;

a closure flap hingedly connected to the top edge of said front panel, said closure flap having an adhesive portion disposed on at least one free edge thereof opposite said hinged connection to said front panel, said closure flap including a V-shaped formation with convex and concave sides of perforations centrally disposed between the side edges therof such that the apex of said V-shaped formation of perforations points toward said hinged connection of said closure flap to said front panel, the concave side of said V-shaped formation facing toward the free edge of said closure flap and terminating at the free edge in a pair of unperforated separation lines generally perpendicular to said top edge of said closure flap along which separation occurs during opening of said envelope.

* * * * *